US005737428A

United States Patent [19]

Roberts

[11] Patent Number: 5,737,428

[45] Date of Patent: Apr. 7, 1998

[54] CIRCUIT FOR PROVIDING VISUAL INDICATION OF FEEDBACK

[75] Inventor: John H. Roberts, Hickory, Miss.

[73] Assignee: Peavey Electronics Corporation, Meridian, Miss.

[21] Appl. No.: 516,776

[22] Filed: Aug. 18, 1995

[51] Int. Cl.[6] ..... H04R 29/00

[52] U.S. Cl. ..... 381/58; 381/98; 381/103

[58] Field of Search ..... 381/1, 98, 58, 381/103, 101, 102, 56

[56] References Cited

U.S. PATENT DOCUMENTS

| | | | |
|---|---|---|---|
| 3,903,470 | 9/1975 | Mirabile et al. . | |
| 3,914,758 | 10/1975 | Ingle . | |
| 3,927,402 | 12/1975 | Thompson . | |
| 3,952,247 | 4/1976 | Horichi . | |
| 4,149,150 | 4/1979 | Miyakawa et al. . | |
| 4,166,245 | 8/1979 | Roberts . | |
| 4,213,125 | 7/1980 | Watanabe . | |
| 4,243,985 | 1/1981 | Quayle . | |
| 4,296,375 | 10/1981 | Takezaki . | |
| 4,307,340 | 12/1981 | Inami et al. . | |
| 4,348,666 | 9/1982 | Ogita . | |
| 4,351,216 | 9/1982 | Hamm . | |
| 4,359,601 | 11/1982 | England | 381/1 |
| 4,368,435 | 1/1983 | Bloy | 381/98 |
| 4,424,511 | 1/1984 | Alberts, Jr. . | |
| 4,480,221 | 10/1984 | Shozima . | |
| 4,528,501 | 7/1985 | Dorrough et al. . | |
| 4,532,472 | 7/1985 | Ishino . | |
| 4,559,497 | 12/1985 | Farrugia | 324/133 |
| 4,559,569 | 12/1985 | Otsuki et al. . | |
| 4,612,665 | 9/1986 | Inami et al. . | |
| 4,614,942 | 9/1986 | Molinaro . | |
| 4,661,982 | 4/1987 | Kitazato et al. . | |
| 4,706,289 | 11/1987 | Jensen | 381/58 |
| 4,771,280 | 9/1988 | Molinaro . | |
| 4,839,584 | 6/1989 | Fukuda et al. | 381/56 |
| 4,891,841 | 1/1990 | Bohn . | |
| 4,939,782 | 7/1990 | Gambacurta, Jr. . | |
| 4,947,133 | 8/1990 | Thomas | 381/106 |
| 4,973,897 | 11/1990 | Ohsawa | 381/103 |
| 5,050,217 | 9/1991 | Orban . | |
| 5,119,426 | 6/1992 | Roberts . | |
| 5,537,614 | 7/1996 | Hagimori et al. | 381/103 |

*Primary Examiner*—Wing F. Chan
*Assistant Examiner*—Xu Mei
*Attorney, Agent, or Firm*—Watson Cole Stevens Davis, P.L.L.C.

[57] ABSTRACT

A compound differential circuit detects the highest relative signal of a plurality of input signals. Peak detector circuits including a sensing diode and a capacitor, are employed to produce a control signal. A switch receives the corresponding control signal. One switch is active at a time in response to the highest control signal. An LED connected to the activated switch is illuminated so that a visual indication of the highest input signal is displayed. In another embodiment, a feedback sensor for a graphic equalizer is disclosed.

13 Claims, 1 Drawing Sheet

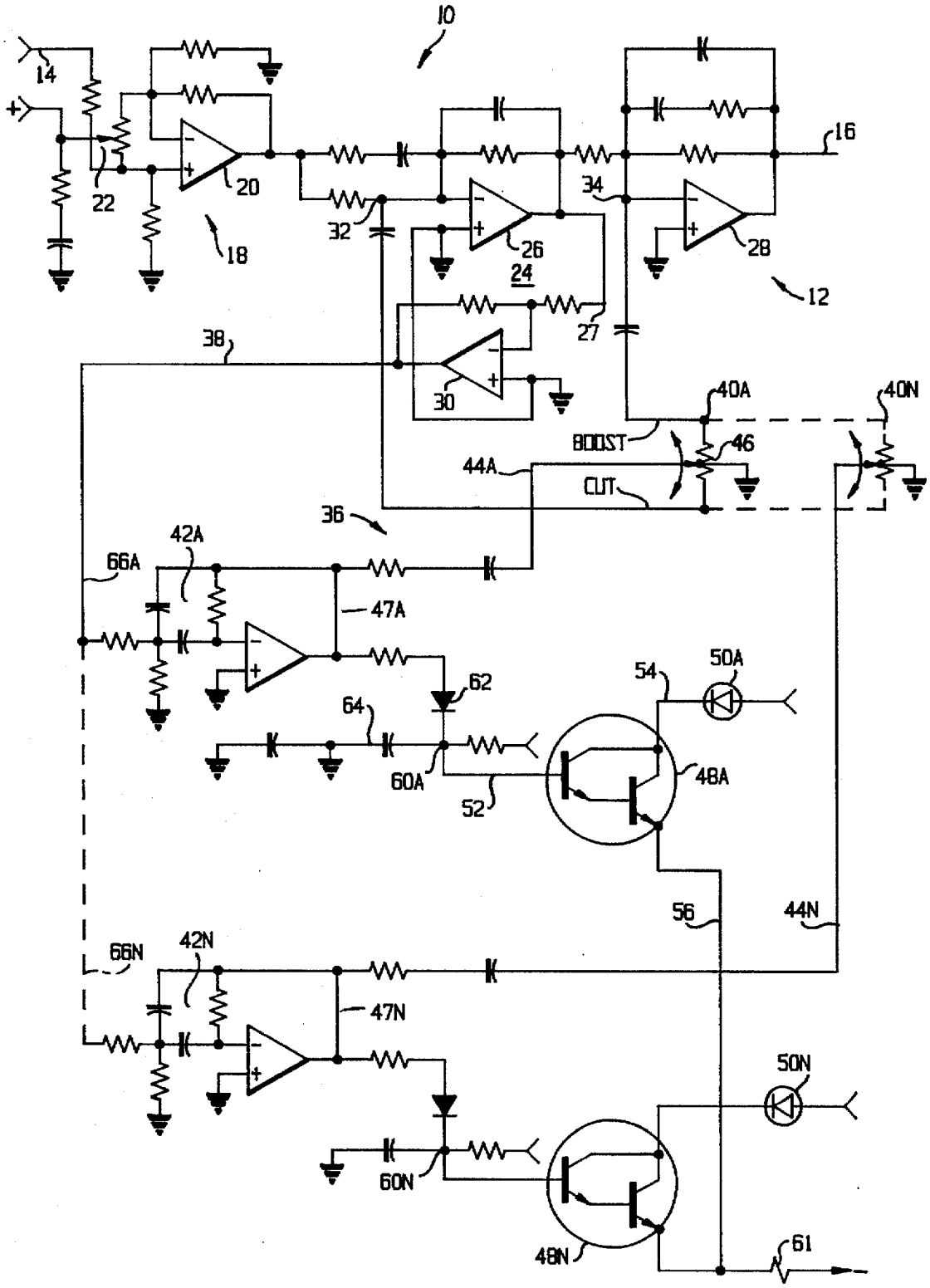
10
14
16
22
20
18
32
26
24
34
28
12
27
38
30
40A
40N
BOOST
46
44A
CUT
36
42A
66A
47A
62
54
50A
64
60A
52
48A
56
44N
66N
42N
47N
50N
60N
48N
61

CIRCUIT FOR PROVIDING VISUAL INDICATION OF FEEDBACK

BACKGROUND OF THE INVENTION

The invention is directed to a device for detecting the highest signal among a plurality of signals. In particular, the invention is directed to a circuit for providing a visual indication feedback in an audio circuit so that a fast and accurate adjustment may be made to reduce such feedback.

Graphic equalizers and other devices are employed for separately controlling, balancing or segregating audio signals into different channels. Such devices are often provided with one or more visually discernable indicators for each channel to assist the operator in adjusting or balancing the various channels in order to achieve a certain desirable audio output. For example, adjustments may be made as to on/off state, volume, frequency, signal delay, etc., in order to provide a variety of effects.

Numerous devices are available in the art for providing such visual indications. For examples, meters or lights are often provided to show signal levels and the like. However, meters are expensive and complicated to incorporate into audio circuits. Also, while meters may be more accurate in terms of the actual absolute value of the signal, it is often just as useful, less complex and less expensive and therefore desirable to provide a visual indication by varying the intensity of a light emitting device.

In some situations, however, it is desirable to specifically differentiate certain signals from all others. For example, in audio systems, graphic equalizers are employed to vary the signal strength, that is, the cut or boost of the signal in selected frequency ranges or bands. If a particular band of frequencies is more intense than all other bands, it is possible to produce undesirable feedback. Typically, the loudest signal causes the feedback or squeal that occurs when the microphone picks up the output from the speaker and amplifies it until it runs away. It is difficult, however, to determine which channel in the equalizer has the loudest or highest signal. Meters are dynamic and are hard to track. Likewise, it is difficult to readily discern which one of a plurality of variable intensity lights is the brightest and hence indicative of the highest signal.

It is therefore desirable to provide a system for visually sensing the highest amplitude signal in a multi-channel circuit. Such a system would readily allow the operator to see and quickly adjust the volume of the channel. Such a system would also be particularly useful as a feedback sensor in a graphic equalizer.

SUMMARY OF THE INVENTION

The invention is based upon the discovery that a compound differential circuit may be employed for detecting the highest relative signal of a plurality of input signals.

In an exemplary embodiment, a plurality of peak detector circuits, each including a sensing diode and a capacitor, are employed to detect each input and to produce a corresponding signal. A plurality of solid state three terminal switching devices, one each responsively coupled to a corresponding one of the peak detector circuits receives the corresponding control signal. Each switch has an output terminal and a common terminal. The common terminals are coupled together so that only one of the switches is active at a time in response to the highest control signal. A visual display employs a plurality of light emitting diodes (LED), one each responsively coupled to the output of a corresponding switch. The LED connected to the active switch is illuminated so that a visual indication of the highest input signal is displayed.

In another embodiment, a feedback sensor for a graphic equalizer is provided. An amplifier amplifies an input signal and produces an output signal. A plurality of band pass filters each having a selected center frequency and bandwidth is responsive to the input signal for producing a corresponding frequency limited output signal. Each band pass filter has an adjustment for the amplifier to vary the amplifier gain at the center frequency of each band. A sensor responsive to the output of each filter produces a peak control signal for each center frequency. A switch for each detector is responsive to the control signal. A visual display means coupled to each switch provides a visual indication upon actuation of the corresponding switch. The switches are commonly coupled so that only one switch is activated in accordance with the highest relative signal from each band pass filter.

BRIEF DESCRIPTION OF THE DRAWINGS

The drawing is a schematic illustration of a graphic equalizer circuit employing a feedback or highest signal detector circuit according to the present invention.

DESCRIPTION OF THE INVENTION

In the embodiment illustrated, an amplifier 12 has an input 14 and an output 16. The amplifier 12 has a first gain control stage 18 including an operational amplifier 20 and a gain control 22 in the form of a potentiometer in the feedback loop. The gain control amplifier stage 18 feeds the two stage amplifier 24 which includes first and second operational amplifiers 26 and 28. The first stage 26 has an output 27 coupled to an inverting feedback amplifier 30. The amplifier 24 is bridged between an input 32 of the first stage 26 and an input 34 of the second stage 28 by a bridging circuit 36. The amplifier 30 produces an output to the bridging circuit 36 on lead 38.

In the present invention, the bridging circuit 36 may include a plurality of boost/cut controls 40A–40N, a corresponding plurality of filter networks 42A–42N, one for each of a plurality of frequency bands, and an RC coupled control lead 44A–44N coupled from the center tap 46 of the cut/boost control 40 and to the corresponding output 47A–47N of filters 42A–42N.

In addition, the bridging circuit 36 includes a plurality of driver amplifiers 48A–48N which are respectively coupled to light emitting diodes or indicators 50A–50N. The driver amplifiers 48A–48N may be three terminal devices, as shown, (e.g., as a Darlington pair).

Each driver amplifier 48A–48N has a base or input lead 52, a collector or output lead 54 and an emitter lead 56. The base 52 of each respective driver amplifier 48A–48N is coupled to the output 48 of the corresponding filter 42A–42N, through an associated peak detector circuit 60A–60N, as shown. The collector 54 of each driver amplifier 48A–48N is likewise coupled to the corresponding light emitting diode 50A–50N. The emitters 56 of each of the driver amplifiers 48A–48N are commonly connected to a reference current (e.g., employing a resistor 61 connected to a negative voltage), as illustrated.

In the illustrative embodiment, each peak detector circuit 60A–60N comprises a sensing diode 62 and a storage capacitor 64.

Each filter 42A–42N has a selected bandwidth and corresponding center frequency. Signals from the amplifier stage 30 on lead 38 feed common connected inputs 66A–66N of filters 42A–42N. The output 48A–48N of each filter is detected by the associated detector circuit 60A–60N. For example, the signal present at the output 47A of filter 42A may be stored in the storage capacitor 64 which applies a potential on the base 52 of driver amplifier 48A.

When a signal is present, the driver amplifier 48A–48N with the largest potential on its base captures all the current causing the associated light emitting diode 50A–50N to become illuminated. At the same time, all of the other driver amplifiers are consequently not energized. Thus, only one of the light emitting diodes 50A–50N corresponding to the filter 42A–42N with the highest signal is illuminated. On occasion, in those frequency regions between bands, it may happen that two driver amplifiers become illuminated. This can happen when the signal is more or less evenly split between driver amplifiers of adjacent bands. In such a case, the operator may selectively reduce or cut the corresponding control 46A–46N for the two bands.

The combination of a plurality of detector circuits 60A–60N, driver amplifiers 48A–48N with common emitters and light emitting diodes 50A–50N in the collector circuit form a compound differential circuit, that is, a circuit which is capable of detecting or differentiating the relative maximum of one signal from a plurality of signals. The circuit illustrated in the drawing may be combined with other useful circuits such as indicator circuits showing the relative volume of the various bands, such as illustrated in U.S. Pat. Nos. 5,119,426 and 4,166,245.

In the exemplary embodiment, it can be appreciated that the frequency response of the circuit may be selectively adjusted by selectively varying the boost or cut of the control circuits 40A–40N for each filter 42A–42N. Thus, the frequency response of the entire amplifier may be selectively controlled over a wide range of frequencies. The present invention also allows the user to sense which band is the loudest by visual observation of the corresponding light emitting diode and thus reduce the frequency response of such band, if desired. If unpleasant feedback occurs, the invention allows the operator to quickly detect the source and reduce the feedback without unduly limiting the frequency response of the amplifier. At the same time, if the sound is not quite right, the operator may raise the frequency response of an individual filter up to some point where the visual indication changes, thereby indicating a change in the signal balance from one filter to the next.

The present invention is particularly useful in a circuit for reducing feedback noise quickly and accurately. The loudest or highest signal passing through the amplifier may undesirably produce feedback squeal. The invention produces a visual indication of the source (e.g., the band or channel) of such feedback. As a result, the operator may reduce the output of the particular filter and suppress the feedback noise. It may happen that other bands are also producing feedback, but each can be selectively reduced in turn so as to provide maximum frequency response from each of the filters without guess work.

While there have been described what are at present considered to be the preferred embodiments of the present invention, it will be apparent to those skilled in the art that various changes and modifications may be made therein without departing from the invention, and it is intended in the appended claims to cover such changes and modifications as fall within the spirit and scope of the invention.

What is claimed is:

1. A circuit for detecting the highest relative signal of a plurality of input signals comprising:

a plurality of peak detector circuits, one each of said peak detector circuits responsively coupled to a corresponding one of said input signals for producing a corresponding switch control signal proportional to the peak value of said input signal;

a plurality of solid state switches including a common connection with each other, one each of said switches responsively coupled to a corresponding one of the peak detector circuits for receiving the switch control signal, the common connection of said switches being operative so that only one of said switches is active at a time in response to the highest switch control signal; and visual display means including one each responsively coupled to the a corresponding switch and being illuminated upon actuation of said corresponding switch so that a visual indication of only the highest input signal is displayed.

2. The circuit of claim 1 wherein the switches each include an input terminal for receiving the corresponding peak detector signal; an output terminal connected to the visual display means and a common terminal for common connection with each other switch.

3. The circuit of claim 1 wherein the peak detectors each comprise a series connected diode and a capacitor, the input to the switch being coupled to a node therebetween.

4. The circuit of claim 1 wherein the switch comprises a Darlington circuit having a base input, a collector output and a common emitter circuit.

5. The circuit of claim 1 wherein the switches each have a conductive and non-conductive state and include diode means coupled to the common connection for causing the switch to assume a non-conductive state wherein one of said switches is conductive.

6. The circuit of claim 5 further comprising a plurality of band pass filters responsive to the input signal, each having a selected center frequency and bandwidth and producing a corresponding frequency selective output signal.

7. The circuit of claim 6 wherein one each of the peak circuits is coupled to a corresponding filter and responsive to the output of each filter for producing the switch control signal corresponding to a peak signal for each center frequency.

8. The circuit of claim 1 further comprising amplifier means for amplifying an input signal and producing an output signal.

9. The circuit of claim 8 further comprising gain control means coupled to each band pass filter and the amplifier means for varying the amplifier gain at the center frequency.

10. A circuit for detecting the highest relative signal of a plurality of input signals comprising:

a plurality of peak detector circuits, each including a sensing diode and a capacitor, one each of said peak detector circuits responsively coupled to a corresponding one of said input signals for producing a corresponding control signal proportional to the peak value of said input signal;

a plurality of solid state three terminal switching devices, including an input terminal, an output terminal and a common output terminal one each of said switching devices having its corresponding input terminal responsively coupled to a corresponding one of the peak detector circuits for receiving the control signal, the common terminals of said switching devices being coupled together so that only one of said switching devices is active at a time in response to the highest control signal; and visual display means including a plurality of light emitting diodes, one each responsibly coupled to the output terminal of a corresponding switching device by the highest control signal and being illuminated upon actuation of only said corresponding switching device so that a visual indication of the highest peak input signal is displayed.

11. A feedback sensor for a graphic equalizer circuit comprising:

amplifier means for amplifying an input signal and producing an output signal;

a plurality of band pass filters responsive to the input signal, each having a selected center frequency and bandwidth and producing a corresponding frequency selective output signal;

gain control means coupled to each band pass filter and the amplifier means for varying the amplifier gain at the center frequency;

detector means responsive to the output of each filter for producing a peak signal for each center frequency;

switch means responsive to the detector means for each peak signal; and visual display means coupled to the switch means for providing a visual indication of a highest one of said peak signals, said switch including coupling means effective in said switch means to activate the visual display means associated with a peak signal corresponding to only the highest one thereof.

12. A feedback sensor for a graphic equalizer circuit comprising:

amplifier means for amplifying an input signal and producing an output signal;

a bridge circuit coupled across the amplifier means for bridging the same including:

a plurality of band pass filters responsive to the input signal, each having a selected center frequency and bandwidth and producing a corresponding frequency selective output signal;

gain control means coupled to each band pass filter for varying the amplifier gain at the center frequency;

a plurality of peak detector means, one each responsive to the output of each filter for producing a peak signal for each center frequency;

a plurality of commonly connected switch means, one each responsive to the peak detector means for each filter, one of said plurality of switch means for producing an output corresponding to the highest one of the peak signals; and visual display means coupled to the switch means for providing a visual indication of only the highest one of said peak signals.

13. A sensor for detecting audio feedback between a speaker and a microphone comprising:

amplifier means for amplifying the microphone signal and producing an output signal;

a plurality of band pass filters responsive to the microphone signal, each having a selected center frequency and bandwidth and producing a corresponding frequency selective output signal;

gain control means coupled to each band pass filter and the amplifier means for varying the amplifier gain at the center frequency;

detector means responsive to the output of each filter for producing a peak signal for each center frequency;

switch means responsive to the detector means for each peak signal; and visual display means coupled to the switch means for allowing a visual identification of a highest one of said peak signals corresponding to audio feedback from said speaker, said switch including coupling means effective in said switch means to activate the visual display means associated with a peak signal corresponding to only the highest one thereof.

* * * * *